US008684093B2

(12) United States Patent
Segura et al.

(10) Patent No.: US 8,684,093 B2
(45) Date of Patent: Apr. 1, 2014

(54) ELECTROMECHANICAL ACTUATOR APPARATUS AND METHOD FOR DOWN-HOLE TOOLS

(75) Inventors: Pedro R. Segura, Round Rock, TX (US); Daniel Q. Flores, Houston, TX (US); William F. Trainor, Houston, TX (US)

(73) Assignee: Bench Tree Group, LLC, Georgetown, TX (US)

( * ) Notice: Subject to any disclaimer, the term of this patent is extended or adjusted under 35 U.S.C. 154(b) by 151 days.

(21) Appl. No.: 13/092,104

(22) Filed: Apr. 21, 2011

(65) Prior Publication Data

US 2011/0259600 A1 Oct. 27, 2011

Related U.S. Application Data

(60) Provisional application No. 61/327,585, filed on Apr. 23, 2010.

(51) Int. Cl.
*E21B 34/10* (2006.01)

(52) U.S. Cl.
USPC ..... 166/374; 166/72

(58) Field of Classification Search
USPC ..... 166/65.1, 66.4, 104, 105, 105.1, 178, 166/250.01, 250.15, 383; 175/26, 40, 92
See application file for complete search history.

(56) References Cited

U.S. PATENT DOCUMENTS

| | | | | |
|---|---|---|---|---|
| 4,498,541 | A | 2/1985 | Brieger et al. | |
| 4,997,037 | A | 3/1991 | Coston | |
| 6,002,643 | A | 12/1999 | Tchakarov et al. | |
| 6,012,518 | A * | 1/2000 | Pringle et al. | 166/66.4 |
| 6,016,288 | A | 1/2000 | Frith | |
| 6,182,750 | B1 * | 2/2001 | Edwards et al. | 166/55.1 |
| 6,244,351 | B1 * | 6/2001 | Patel et al. | 166/386 |
| 6,354,374 | B1 * | 3/2002 | Edwards et al. | 166/297 |
| 6,898,150 | B2 | 5/2005 | Hahn et al. | |
| 6,959,760 | B1 | 11/2005 | Braithwaite et al. | |
| 7,417,920 | B2 | 8/2008 | Hahn et al. | |
| 7,564,741 | B2 | 7/2009 | Pratt et al. | |
| 8,118,098 | B2 * | 2/2012 | Hromas et al. | 166/298 |
| 8,267,196 | B2 * | 9/2012 | Hall et al. | 175/57 |
| 2002/0159333 | A1 | 10/2002 | Hahn et al. | |
| 2005/0104176 | A1 | 5/2005 | Rodney et al. | |
| 2005/0260089 | A1 | 11/2005 | Hahn et al. | |
| 2006/0169463 | A1 | 8/2006 | Howlett | |
| 2007/0056724 | A1 | 3/2007 | Spring et al. | |
| 2009/0095490 | A1 | 4/2009 | Moriarty et al. | |

FOREIGN PATENT DOCUMENTS

WO WO 2009/070751 4/2009

OTHER PUBLICATIONS

PCT/US2011-033639, International Search Report dated Jul. 12, 2011.
PCT/US2011-033639, Written Opinion dated Jul. 12, 2011.

* cited by examiner

*Primary Examiner* — Daniel P Stephenson
(74) *Attorney, Agent, or Firm* — DLA Piper LLP (US)

(57) ABSTRACT

An apparatus and method for the actuation of down-hole tools are provided. The down-hole tool that may be actuated and controlled using the apparatus and method may include a reamer, an adjustable gauge stabilizer, vertical steerable tools, rotary steerable tools, by-pass valves, packers, whip-stocks, down hole valves, latch or release mechanisms and/or anchor mechanisms.

24 Claims, 6 Drawing Sheets

ELECTROMECHANICAL ACTUATOR APPARATUS AND METHOD FOR DOWN-HOLE TOOLS

PRIORITY CLAIM/RELATED APPLICATIONS

This application claims the benefit under 35 USC 119(e) and 120 to U.S. Provisional Patent Application Ser. No. 61/327,585, filed on Apr. 23, 2010 and entitled "Electromechanical Actuator Apparatus And Method For Down-Hole Tools", the entirety of which is incorporated by reference herein.

FIELD

The apparatus is generally directed to an electromechanical actuator and in particular to an electromechanical actuator for tools used for bore hole drilling, work-over and/or production of a drilling or production site which are used primarily in the gas and/or oil industry.

BACKGROUND

Electromechanical actuator systems generally are well known and have existed for a number of years. In the down-hole industry (oil, gas, mining, water, exploration, construction, etc), an electromechanical actuator may be used as part of tools or systems that include but are not limited to, reamers, adjustable gauge stabilizers, vertical steerable tools, rotary steerable tools, by-pass valves, packers, down hole valves, whipstocks, latch or release mechanisms, anchor mechanisms, or measurement while drilling (MWD) pulsers. For example, in an MWD pulser, the actuator may be used for actuating a pilot/servo valve mechanism for operating a larger mud hydraulically actuated valve. Such a valve may be used as part of a system that is used to communicate data from the bottom of a drilling hole near the drill bit (known as down hole) back to the surface. The down hole portion of these communication systems are known as mud pulsers because the systems create programmatic pressure pulses in mud or fluid column that can be used to communicate digital data from the down hole to the surface. Mud pulsers generally are well known and there are many different implementations of mud pulsers as well as the mechanism that may be used to generate the mud pulses.

The existing systems have one or more of the following problems/limitations that it are desirable to overcome:

- Have a large number of components resulting in a larger, longer, heavier device that is difficult to maintain and requires more power than is necessary.
- Have a large number of components and components that cannot be easily accessed, thereby complicating maintenance and reducing reliability
- Have elastomeric membrane compensation which results in reduced survivability, especially in environments which deteriorate the elastomeric membrane
- Do not have shock absorbing, self aligning systems or a controlled load rate feedback mechanism
- Do not have a securely attached the shaft while simplifying it's installation and removal using a structural connection of the "t-slot configuration"
- Do not separate a screen housing from the oil compensated, sealed section and do not have a "debris trap(s)" in the screen housing which reduces the chance of clogging of a downhole valve
- Do not have supplemental motor controls for improving reliability of the motor Thus, it is desirable to have an electromechanical actuator system that overcomes the limitations of the above typical systems and it is to this end that the disclosure is directed.

DETAILED DESCRIPTION OF ONE OR MORE EMBODIMENTS

The apparatus and method are particularly applicable to the actuation of down-hole tools, such as in borehole drilling, workover, and production, and it is in this context that the apparatus and method will be described. The down-hole tools that may utilize, be actuated and controlled using the apparatus and method may include but are not limited to a reamer, an adjustable gauge stabilizer, vertical steerable tool, rotary steerable tool, by-pass valve, packer, control valve, latch or release mechanism, and/or anchor mechanism. For example, in one application, the actuator may be used for actuating a pilot/servo valve mechanism for operating a larger mud hydraulically actuated valve such as in an MWD pulser. Now, examples of the electromechanical actuator are described in more detail below.

Figure 1:
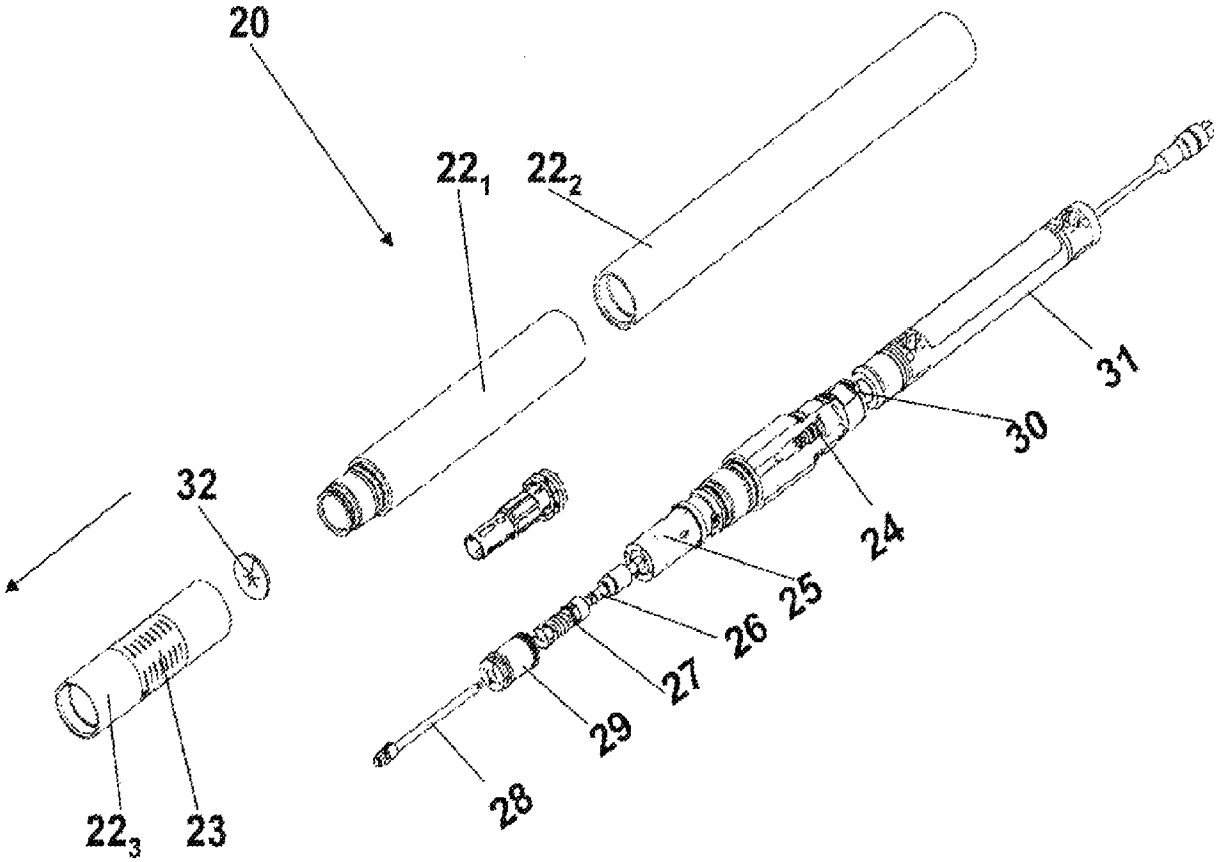
FIG. 1 is an illustration of a preferred embodiment of an electromechanical actuator.
Figure 2:
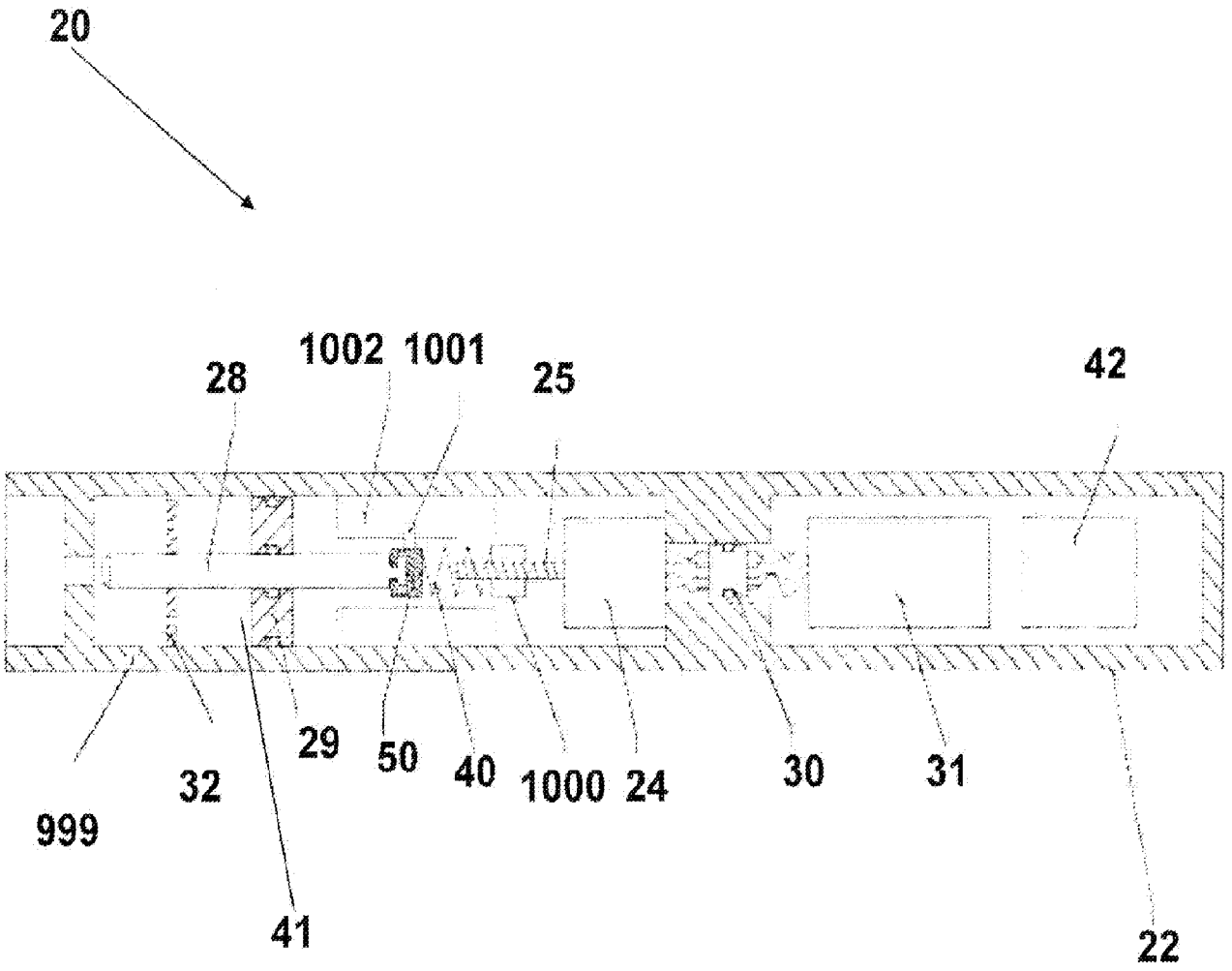
FIG. 2 illustrates an embodiment of the electromechanical actuator of FIG. 1.

FIG. 1 is an illustration of an electromechanical actuator 20 that may be used, for example, in a down-hole MWD pulser tool. The actuator may comprise a first and second housing $\mathbf{22}_1$, $\mathbf{22}_2$ that house a number of components of the actuator and a valve housing $\mathbf{22}_3$ that connects to the housing $\mathbf{22}_1$ and has a replaceable screen 23 that houses the components of the actuator that are not within the oil filled housing $\mathbf{22}_1$. Those components of the actuator that are not within the oil filled housing can thus be more easily accessed by removing the replaceable screen so that those components are exposed for more easily assembly and disassembly, and maintenance can conveniently be performed on them. The actuator may further comprise a rotary actuator 25, a lead or ball screw 26 and a reciprocating member(s) 27 that actuate the servo shaft of down hole tool. The actuator may also have a shock absorbing and self aligning member 27 that absorbs the shocks from the actuator and compensates for misalignments between the members. In one implementation (for a particular set of load and temperature requirements), the shock absorbing member(s) 27 (as shown in FIG. 2) may be a machined helical spring that is made of metal integral to the coupling between the reciprocating nut of the ball screw 26 and the shaft 28. However, the shock absorbing member(s) may take other forms and may also be made of different materials as would be chosen by someone of ordinary skill in the art and depending on the load and temperature requirements for a particular application. The actuator may also have a shaft 28 that connects to the downhole tool through a compensation piston 29 and a sometimes a buffer disc 32 whose function is described below in more detail. The buffer disc 32 (see also FIG. 2) may be made of a high temperature thermoplastic, but may also be made of other materials depending on the load and temperature requirements for a particular application.

The actuator 20 may also have a fluid slurry exclusion and pressure compensating system 29 that balances pressure within the actuator with borehole pressure. (The actuator may also have a pressure sealing electrical feed thru 24 that allows the actuator to be electrically connected to electronic control components, but isolates the electronic control components from fluid and pressure. In particular, when downhole, the pressure within the oil filled, pressure compensated system is essentially equal to the pressure in the borehole and this pressure is primarily the result of the fluid column in the borehole. The details of the fluid slurry exclusion and pressure compensating system 29 are described below in more detail. The pressure sealing electrical feed thru 24 may have a metal body with sealing features, metal conductors for electrical feed thru, and an electrically insulating and pressure sealing component (usually glass or ceramic) between the body and each of the conductors. Alternatively, the pressure sealing electrical feed thru 30 may be a plastic body with sealing features and metal conductors for electrical feed thru.

The actuator may also have a set of electronic control components 31 that control the overall operation of the actuator as described below in more detail. The set of electronic control components 31 are powered by an energy source (not shown) that may be, for example, be one or more batteries or another source of electrical power. Now, further details of an example of an implementation of the electromechanical actuator are described in more detail with reference to FIG. 2.

FIG. 2 illustrates an illustration of an embodiment of the electromechanical actuator of FIG. 1. Typical actuator systems may utilize an elastomeric bellows/membrane system for pressure compensation whereas, as shown in FIG. 2, the subject actuator may further comprise a piston 29 that is part of the fluid slurry exclusion and pressure compensating system 29. The piston compensation system is a dielectric fluid filled chamber with features for excluding the abrasive, conductive, corrosive, mud slurry used in drilling and construction from the close tolerance and/or non-corrosion resistant, and/or electrical/electronic components of the actuator assembly 20 while balancing pressure differential across borehole fluid to tool interface seals to minimize actuator load requirements and hence power requirements. In one implementation, the actuator has a compact configuration with a piston over the shaft 28 (in both reciprocating and rotating versions). The piston is located in a position within the assembly as to minimize the system's overall length, improve access to seals and internal mechanism, reduce part count, and enable pressure communication.

The actuator configuration reduces costs by reducing the number of components and material needed for manufacture, simplifying machining, lowering weight and hence reducing logistical costs, and simplifying maintenance by providing improved access to components that require frequent replacement. The location of the piston also eliminates the need for secondary set of fluid pressure vents 999 or ports in the housings as may be needed with typical compensation systems. The location of the piston thus reduces housing OD wear due to fluid slurry erosion by making the outer housing diameter more uniform by excluding the vents, since erosive wear is usually concentrated directly downstream of surface discontinuities.

The actuator implementation shown in FIG. 2 may have a grease pack 41 on an end to buffer the compensation system seals on the OD and ID of the piston 29 from abrasive fluid slurry. The buffer disc 32 aids in retaining grease and excluding larger debris, and also provides additional lateral support for the shaft 28 extending through it. In one implementation, the buffer disc 32 is vented to allow pressure communication between the grease packed volume and the wellbore fluid. In addition or alternatively, the housings adjacent to the buffer disc may also be vented to allow this communication. In one implementation, the buffer disc 32 is captured between two of the housings that thread together (as shown in FIG. 1) so that no other method of fastening or centering it is required. The buffer disc 32 may also be split or slotted to allow assembly/disassembly if a component of diameter larger than the shaft is attached to the end of the shaft and/or position in such a way that the disc cannot be installed by inserting around and over the shaft. The buffer disc 32 may be axially compliant and laterally stiff which is accomplished, in one embodiment, by including multiple radial slits from the inner diameter to a distance less than the outer diameter. The axial compliance of the buffer disc 32 is a release mechanism in the event that debris becomes trapped or wedged between the reciprocating shaft and the buffer disc inner diameter and is also a pressure relief mechanism in the event that pressure fluid vents become clogged. In other embodiments, the buffer disc 32 may be a flexible, compliant member that would not require venting. For example, the buffer disc 32 could be a rubber membrane that would stretch with volume changes without significantly adding a load to the actuator in the instances described above and would also flex in reciprocation or rotation if attached to the shaft. The buffer disc 32 could also be a combination of rigid and elastomeric materials to achieve lateral support and axial compliance.

The shaft 28 that extends from the oil filled section, through the compensation piston 29 ID seal, through the grease pack 41, buffer disc 32 and into the wellbore fluid, may be of uniform diameter to prevent any interference of reciprocating motion by components or debris that may find its way to the area.

In an alternative embodiment, the piston compensation and exclusion system may be converted to an elastomeric membrane compensation system easily by removing the piston 40 and mounting the elastomeric membrane assembly into the same seal area. This embodiment of the actuator may be used for systems requiring the elimination of seal friction, as required for pressure measurement, precise control, or lower force actuators.

In the actuator, the rotary actuator 24, such as a dc motor, for example, is installed with a ball or lead screw 25 integral to or attached to the rotary actuator's 24 output shaft. The screw 25 rotates, the nut 1000 moves linearly, reciprocates, and the nut is then coupled to the actuated/reciprocating member(s)/component(s) 40, 50, 1001, 28. Alternatively, the motor shaft can be attached to the ball or lead screw nut, the nut rotates, the screw moves axially and the screw 25 is integral to and coupled to the actuated/reciprocating member(s)/component(s) 40, 50, 1001. In the embodiment shown in FIG. 2, the nut and attached or integral reciprocating members reciprocate with shaft-screw rotation, but the rotation of the reciprocating, axially moving, member(s) is prevented by an anti-rotation feature or member, 1001. This feature may be, for example, a pin, key, screw-head, ball, or integrally machined feature that slides along an elongated stop or slot 1002 in the surrounding actuator guide or a surrounding housing. Alternatively, the anti-rotation member can be attached to or be integral to the guide/housing, and will prevent rotation of the reciprocating member by sliding along a slot/groove or elongated stop in a reciprocating member(s). Alternatively, the anti rotation member can be captured within elongated stops or slots or keys in both the reciprocating and the stationary member(s). The guide and/or surrounding housing are vented to allow fluid transfer between various cavities that change volume as the actuator reciprocates. In one embodiment as shown in FIG. 1, the guide is attached to the rotary actuator housing.

In one embodiment, the thrust created by loading the reciprocating member is countered by a member which is a combined thrust/radial bearing within the rotary actuator. This member, a bearing, can accommodate the axial and radial loads while minimizing torque requirements of the rotary actuator. This type of bearing is well known. However, typically and in the existing downhole actuators, a thrust bearing(s) external to the rotary actuator are implemented, while the rotary actuator contains only the radial support bearings. Combining the radial and thrust bearing into the actuator, as in the described device, reduces the number of components, improving reliability, and simplifying assembly/disassembly. However, the thrust bearing can alternately or additionally be attached to or integrated within the rotary actuator shaft or ball/lead screw non reciprocating components as is typically done also.

Typical downhole actuator systems require an oversized lead or ball screw, thrust bearings, and reciprocating components to tolerate larger loads that may be caused by impacting at the reciprocating member. This can be the case when seating a rigid valve, for example. In the actuator shown in FIGS. 1 and 2, the system components are significantly smaller due to the addition of an integral or attached shock absorbing member or members 27 in FIG. 1 (and 40 in FIG. 2) such as mechanical springs. The shock absorbing member reduces the peak shock loads and accommodates misalignments, thereby reducing the strength requirements of the other actuator components. The shock absorbing member or members 27/40 may be placed inline or within the rotary actuator shaft, reciprocating members, or between nut and seat, or on thrust bearing (s), or in the actuated devices (external to the actuator). In one embodiment, it is integrated to a coupling which is attached to the reciprocating member of the ball or lead screw 26 as shown in FIG. 2. The integration of the shock absorbing member reduces loads, which enables a reduction in component strength requirements, which enables a reduction in component size, and hence reduces overall component mass, which in turn enables a reduction in the system size and power requirements. This is important, for example, in battery operated systems such as downhole devices that may use the actuator. The smaller components also enable smaller diameter assemblies which is often required in drilling, for example, in systems requiring high fluid flow capability or assemblies to be used in smaller diameter assemblies used in drilling or servicing smaller holes. This is also important when mounting assemblies in the walls of collars or pipe as may be configured for some tools. The shock absorbing member 27 in the preferred embodiment also provides compliance to accommodate assembly misalignments which is important to reduce wear and fatigue of the system components. This compliance may also reduce stresses, which also enables a reduction in components size, thus providing the benefits described above.

For a reciprocating system, the axial compliance of the shock absorbing member(s) 27/40 can also be adjusted to control the rates of load increase and decrease, which provides a control feedback mechanism for the electronics. If a mechanical spring(s), for example, the spring rate(s) can be increased, decreased, or stepped, to alter the detectable load rate. For a rotary system, torsional spring(s) rate(s) can be adjusted as needed to provide feedback/control also.

The shock absorbing member(s) 27/40 in another embodiment includes a mechanical spring(s), which upon loading, compresses or extends. This reduces or increases the size of gaps, which act as fluid vents or ports. As the vents close or open, the change in hydraulic flow area(s) cause changes in load, which can be detected by the electronics for control purposes. This porting can also be integrated to non shock-absorbing components, in which overlapping openings act as the vents or ports for a fluid. The non-restricted fluid passages/openings then vary in flow area as a function of position of the reciprocating components. Here also, the change in flow areas alters the loads which can be detected by the control electronics.

Figure 3:
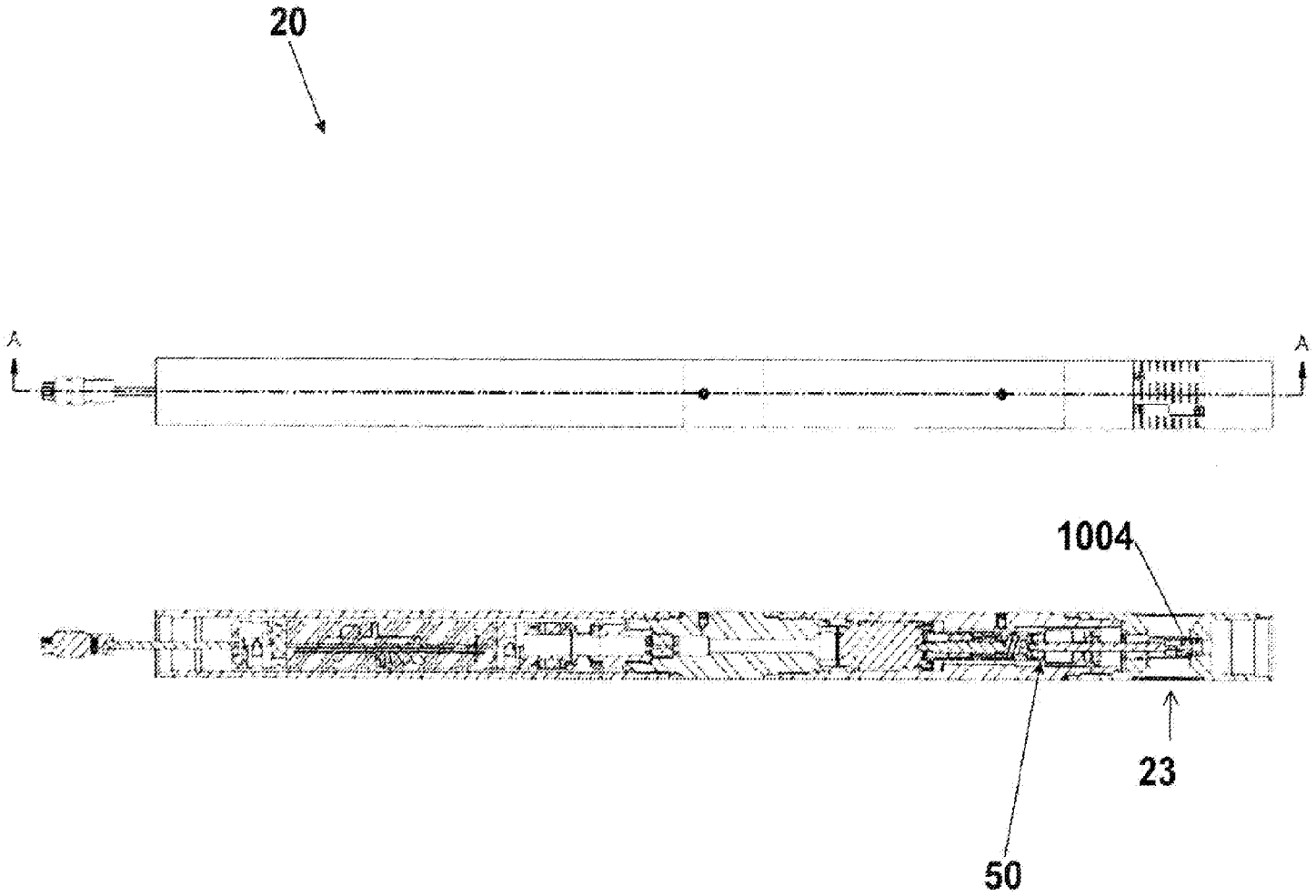
FIG. 3 is an assembly cross-section diagram of the embodiment of the electromechanical actuator of FIG. 2.

FIG. 3 is an assembly cross-section diagram of the embodiment of the electromechanical actuator of FIG. 2. The actuator may also have an easily replaceable shaft 28. As shown in FIGS. 2 and 3, the actuator 20 may have a shaft T-slotted coupling 50 that allows lateral motion for installation and removal of the shaft until a piston or other member that prevents lateral travel is installed. After the piston 29 is installed, the shaft is captured, and lateral motion is prevented by the piston. The shaft 28 is dimensioned to minimize diameter and to minimize volume changes with reciprocation, while maintaining load capacity. The shaft is also dimensioned to allow the piston seal to slide over end attachment features without damaging said piston seal. The shaft is also sized as to minimize the mass, and hence inertia, of the actuated system to reduce power requirements of the motor. The shaft 28 may be attached to the coupling 50 in other ways as well. For example, the shaft can be integral to the coupling or screw, threaded to the coupling or screw, or be attached with clip or threaded fasters. In the embodiment shown in FIG. 3, the coupling allows easy removal and reinstallation while providing a more secure attachment. While threaded fasteners may loosen in high vibration environments, the coupling 50 will not loosen.

The screen assembly 23 may be around the entire OD of the housing. Cavities 1004 between the screen ID and housing slots act as a debris trap(s) on the downhole side of a pilot valve orifice. The housing may trap the buffer disc as discussed above. The screen may be slotted or perforated and relieved for fluid passage. The screen assembly 23 provides a more uniform OD than previously used systems and the changeable screen is designed for easy replacement in case of erosion of a component. The screen assembly 23 also uses a minimal number of retainers/screws to reduce the chance of losing one down-hole.

The seal to the compensation system fluid is not integral to the screen housing as in other systems. This allows screen housing cleaning or replacement without breaching the compensation system. This is important because the screen assembly is prone to erosion due to the OD discontinuities, and because of fluid flow through the assembly when used as a valve. This also allows for field replacement of the screen assembly. This may be important to enable matching the screen type to LCM or fluid type. This also simplifies the manufacturing process in that the screen and screen housing or adapters to drilling tool types may be changed on pre-assembled actuators.

In another embodiment, the actuator assembly may be easily reconfigured to rotary system by replacing the ball or lead screw with a gear box and shaft extending through the compensation piston seal. The gearbox is not required if the motor torque alone is sufficient. In contrast, other systems are either non-compensated or include complicated magnetic couplings. The subject actuator assembly allows use of piston or interchangeable membrane compensation system while minimizing the system's overall length and retaining the other features and benefits described above.

Figure 4:
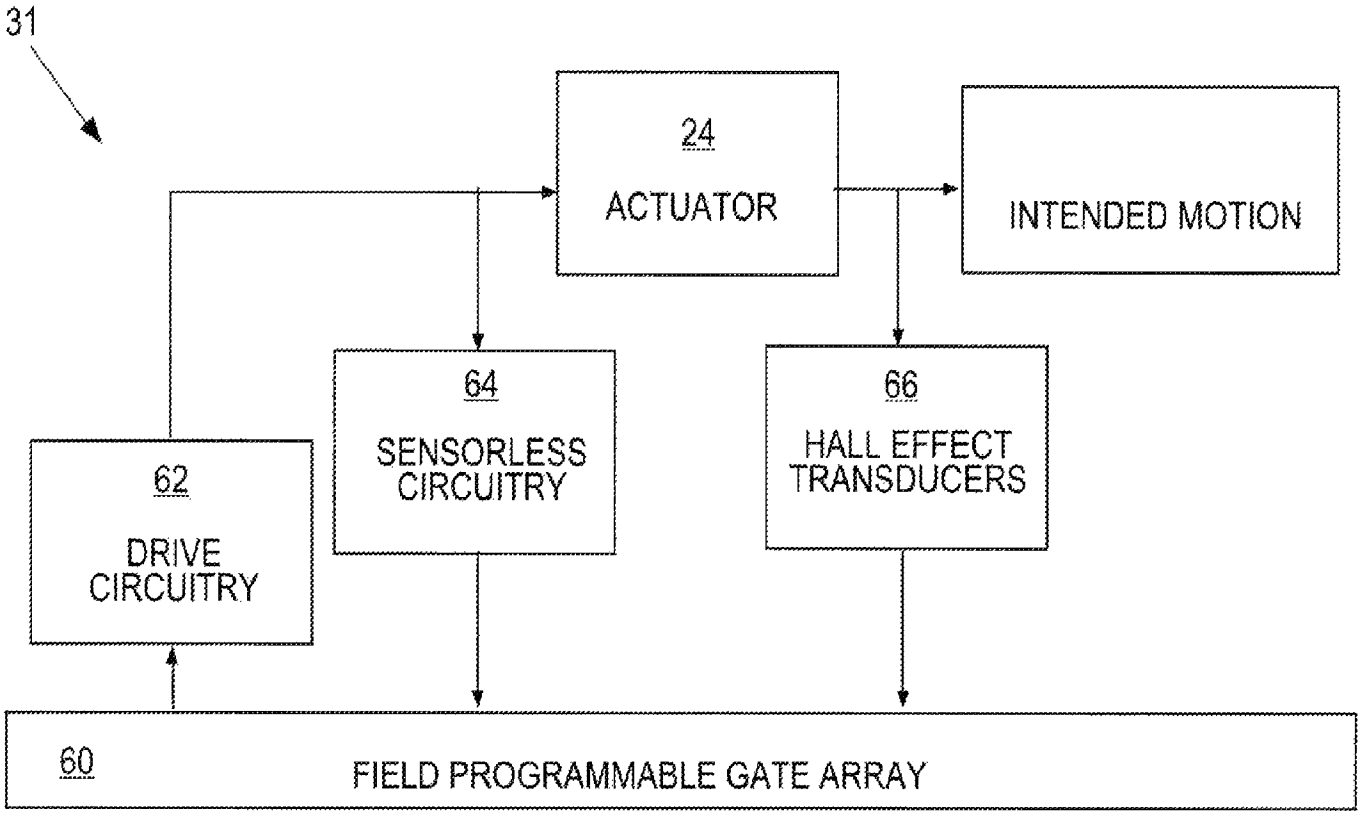
FIG. 4 illustrates a block diagram of an implementation of the set of electronic circuits of the actuator.

The actuator includes the set of electronic control components 31. FIG. 4 illustrates an implementation of the electronic component assembly 31 of the actuator 20. The electronic components may include a state machine, implemented in a micropower flash based Field Programmable Gate Array (FPGA) 60 that controls the motion of the actuator via position feedback generated either by a motion sensing device or back electromotive force. The electronics may further comprise a set of drive circuitry 62 that are controlled by the state machine and generate drive signals to drive the actuator 24 (back EMF signals). Those drive signals are also input to a set of sensorless circuitry 64 which feed control signals back to the state machine that can be used to control the actuator if one or more of the motion sense devices fail as described below. The electronic components may also include one or more well known Hall Effect sensors/transducers 66 that measure the movement/action (intended motion) of the actuator and feed back the signals to the FPGA 60 so that the FPGA can adjust the drive signals for the actuator as needed. In one implementation, the hall effect sensors are contained within a purchased motor assembly. However, the actuator may also use other sensors, such as a synchroresolver, an optical encoder, magnet/reed switch combination, magnet/coil induction, proximity sensor, capacitive sensor, accelerometer, tachometer, mechanical switch, potentiometer, rate gyro, etc.

The transducer feedback signal from the sensors 66 provide the best power efficiency during all mechanical loading scenarios and thus increases battery life and reduces operating costs due to battery replacement. However, Hall effect transducers are prone to malfunction due to the abusive down hole environment. Hall effect transducers are presently considered the preferred motion control device because they are relatively reliable verses other motion sensors in an abusive environment. Thus, in the control electronics, a firmware mechanism is in place to switch over to the less power efficient back electromotive force position feedback using the sensorless circuitry 64 if any one or more of the Hall motion control devices. (Hall A sensor, Hall B sensor and Hall C sensor, for example) fail to return diagnostic counts. For example, the method may operate as follows: if Hall B fails to generate diagnostic counts, then Hall A will be utilized, back electromotive force signal B will be utilized, and Hall C will be utilized. Power efficiency will not suffer in this case and reliability will be maintained. If more than one Hall effect transducers fails, the firmware will rely altogether on the back electromotive force position feedback (back electromotive force signal A, back electromotive force signal B and back electromotive force signal C) and power efficiency will now be reduced somewhat, but proper operation will still be maintained.

Figure 5:
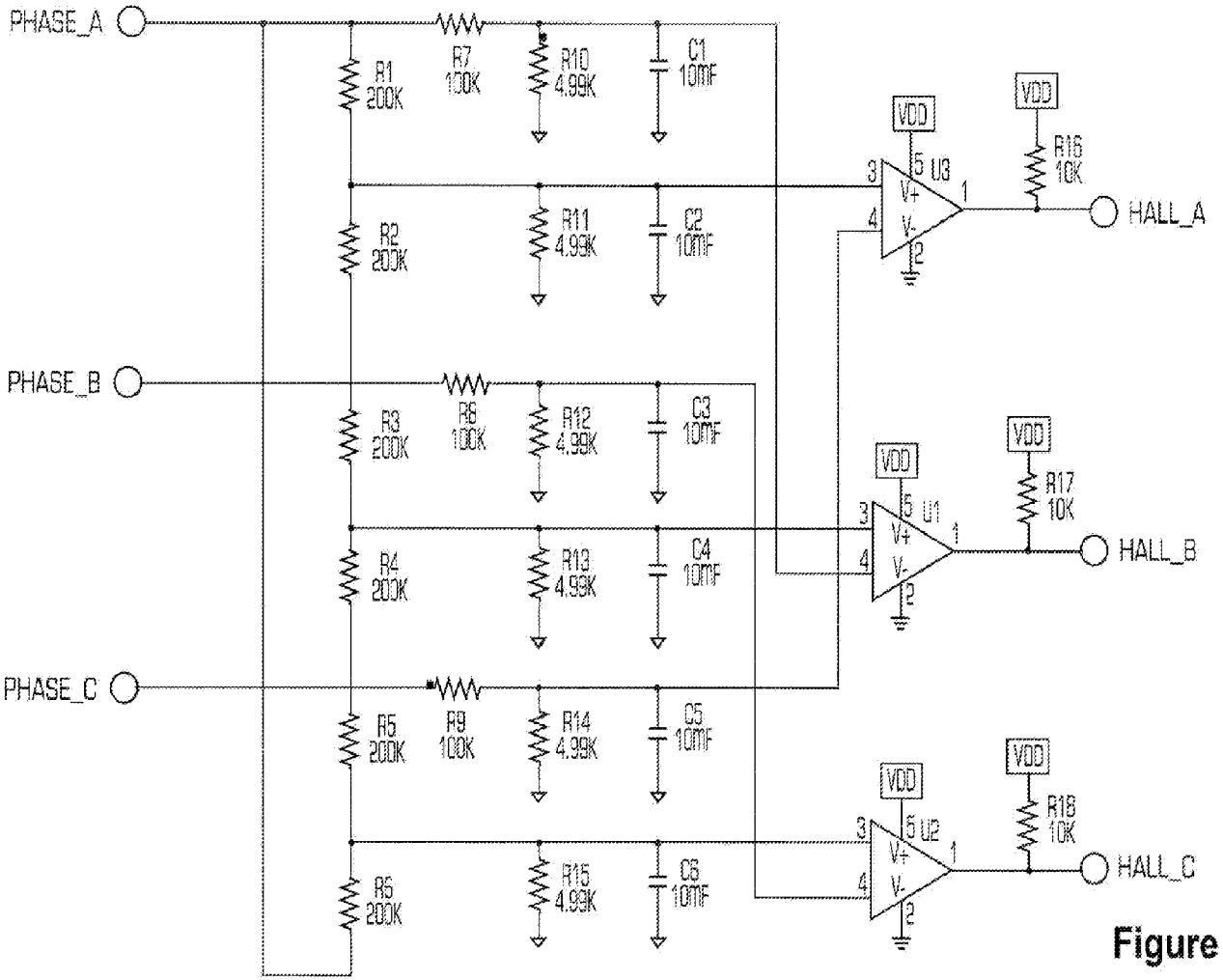
FIG. 5 illustrates an implementation of a circuit that converts back EMF signals into Hall signal equivalents.

FIG. 5 illustrates an implementation of a circuit that converts back EMF signals into Hall signal equivalents. In the implementation shown, the back EMF signals (Phase A, Phase B and Phase C) are converted using resistors, capacitors and operational amplifiers [comparators] as shown to generate the Hall A, Hall B and Hall C signals as shown if this were a three phase system.

The set of electronic control components 31 may also provide diagnostic/logging data functions that may be recorded using mission critical tactics. Typical methods of storing nonvolatile data are usually writing data to flash memory in large, quantized, page segments so that, if a power anomaly or reset occurs during a page write a large amount of data can be easily lost. A typical 1 kilobyte page may store hours of diagnostic or log data. In order to prevent this loss of data, a new type of nonvolatile memory, other than flash, may be utilized that allows for fast single byte writes instead of large, susceptible 1 kilobyte page writes to flash memory. In one implementation, the nonvolatile memory may be a ferroelectric random access memory (F-RAM) which is a nonvolatile memory which uses a ferroelectric layer instead of the typical dielectric layer found in other non-volatile memories. The ferroelectric layer enables the F-RAM to consume less power, endure 100 trillion write cycles, operate at 500 times the write speed of conventional flash memory, and endure the abusive down hole environment. The use of the new type of nonvolatile memory minimizes data loss via a single byte transfer instead of a 1 kilobyte data transfer.

Figure 6:
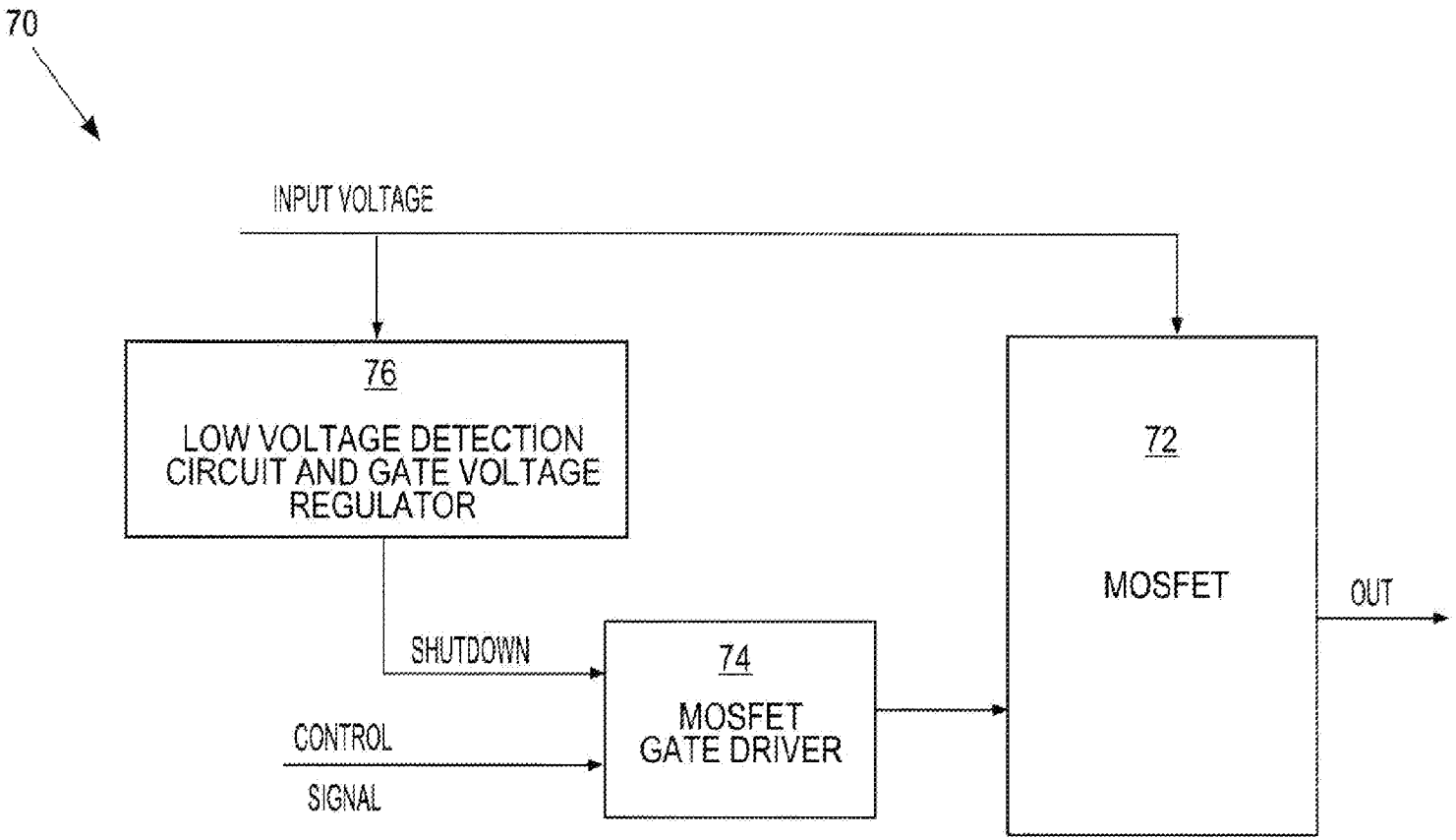
FIG. 6 illustrates an implementation of the MOSFET drive circuitry of the actuator.

The set of electronic control components 31 may also have special MOSFET gate driver circuitry 70 (See FIG. 6 that illustrates an implementation of the MOSFET drivers 70) that are utilized in order to regulate the gate drive voltage applied to one or more MOSFETs 72 over changing input voltage wherein the input voltage is typically supplied by batteries. A MOSFET is the preferred switch; however, any other switch can be utilized. In the circuitry, each MOSFET has a gate driver circuit 74 that generates the gate voltage for each MOSFET and a low voltage detection circuit and gate voltage regulator 76 that controls the gate driver circuit 74 in that it can provide a shutdown signal when the voltage is too low. The regulation of the gate voltage to an optimal voltage allows the MOSFET to dissipate minimal power over large input voltage swings so that MOSFET temperature rise is minimized which increases reliability. The set of electronic control components 31 may also have the circuit 76 that can disable the MOSFETs if the input voltage drops to a level wherein the optimal gate voltage cannot be maintained, thus eliminating MOSFET overheating and self destruction.

The downhole actuator described above also provides a simple method for filling oil into the actuator that contributes to ease of maintenance. In existing system, some of which use a membrane for compensation, the membrane collapse under vacuum (when the oil is removed) creating air traps and possibly damaging the membrane. Furthermore, removing excess oil from existing membrane compensation systems is also more complicated as it is more difficult to access the membrane to displace the oil from the membrane without fixtures that applies pressure to the membrane. The structure and porting required to integrate membrane compensated systems also adds fluid volume to the system which it must compensate for. In contrast, the downhole actuator described above allows vacuum oil filling of the system before installation of the compensation piston or membrane. Thus, the compensating member (piston or membrane) may be removed before the vacuum oil fill process and the compensating member is installed after the vacuum fill is complete. In addition, excess oil is displaced from the system by simply opening a port and installing the compensation piston to the required position.

The actuator described above has the following overall characteristics that overcome the limitations of the typical systems:

- Reduced the number of components to achieve the same functions in a more effective manner
- Simplified cost, maintenance, and improved reliability by reducing the number of components and configuring components for simplified access
- Utilized piston compensation versus elastomeric membrane compensation which improved survivability in environments which deteriorate the elastomeric membrane Added the shock absorbing, self aligning, system which enabled smaller load bearing and reciprocating components Use of a smaller number of components, reducing cost, power requirements and size Added the shock absorbing member(s) and hydraulic restriction scheme to provide a control feedback mechanism Securely attached the shaft while simplifying its installation and removal with the t-slot configuration Added the disc which provides shaft lateral support while not interfering with reciprocation or pressure balancing.

Separated the screens from the oil compensated, sealed section

Added the debris trap to the screen housing which reduces the chance of clogging of a downhole valve Added electronics features to the drive circuitry which improved reliability.

Added recording of diagnostic data that is critical to performance of the actuator to aid in failure analysis and other diagnosis.

Added circuitry to greatly improve MOSFET reliability over all input voltage and abusive environment conditions.

Added redundancy to the motion control devices which operate and control the actuator to improve reliability over other typical systems.

While the foregoing has been with reference to particular embodiments of the disclosure, it will be appreciated by those skilled in the art that changes in this embodiment may be made without departing from the principles and spirit of the disclosure, the scope of which is defined by the appended claims.

The invention claimed is:

1. An actuator for a downhole tool, comprising:

an oil filled housing;

an actuator, housed in the oil filled housing, that generates a force to be applied to a downhole tool that is connectable to the actuator;

a shock absorbing member, adjacent to the actuator, that absorbs shocks from the actuator;

a compensation mechanism, housed in the oil filled housing, that balances the pressure within the actuator with a borehole pressure;

a shaft, housed in the oil filled housing, that transfers the force of the actuator to the downhole tool that is connectable to the actuator; and an electronic control system, in a housing separated from the oil filled housing, that electrically communicates with the actuator to provide a power signal and control signals to the actuator.

2. The downhole tool actuator of claim 1, wherein the actuator further comprises one of a rotary actuator and a reciprocating member.

3. The downhole tool actuator of claim 2, wherein the actuator further comprises a lead/ball screw connected to the actuator and the shaft that ensures a proper motion of the shat based on the actuator motion.

4. The downhole tool actuator of claim 3, wherein the actuator further comprises a T-slot coupling that connects the shaft to the actuator.

5. The downhole tool actuator of claim 2, wherein the actuator further comprises an anti-rotation feature that prevents rotation of the reciprocating member.

6. The downhole tool actuator of claim 5, wherein the anti-rotation feature is one of a pin, a key, a screw-head, a ball and an integrally machined feature that slides along slot in the oil filled housing.

7. The downhole tool actuator of claim 5, wherein the shock absorbing member aligns the shaft.

8. The downhole tool actuator of claim 7, wherein the shock absorbing member is a machined helical spring.

9. The downhole tool actuator of claim 1, wherein the shaft has a uniform diameter.

10. The downhole tool actuator of claim 1, wherein the compensation mechanism is a piston.

11. The downhole tool actuator of claim 1, wherein the piston surrounds the shaft so that an overall length of the actuator is reduced.

12. The downhole tool actuator of claim 1, wherein the compensation mechanism is an elastomeric membrane.

13. The downhole tool actuator of claim 1 further comprising a buffer disc adjacent the compensation mechanism that excludes debris and supports the shaft.

14. The downhole tool actuator of claim 13, wherein the buffer disc is a high temperature thermoplastic.

15. The downhole tool actuator of claim 13, wherein the buffer disc is vented.

16. The downhole tool actuator of claim 13, wherein the oil filled housing further comprises a first housing and a second housing and wherein the buffer disc is retained between the first and second housings.

17. The downhole tool actuator of claim 1 further comprising pressure sealing electrical feed thru that insulates the electronic control system from the pressure and fluid in the oil filled housing.

18. The downhole tool actuator of claim 1, wherein the electronic control system further comprises a set of sensors that generate a set of signals that measure the motion of the shaft, a state machine that generates a signal based on the set of sensor signals and a set of drive circuitry that generate a control signal for the actuator based on the state machine signal.

19. The downhole tool actuator of claim 18, wherein the state machine is a field programmable gate array.

20. The downhole tool actuator of claim 18, wherein each sensor is one of a Hall Effect sensor, a synchroresolver, an optical encoder, a magnet/reed switch combination, a magnet/coil induction sensor, a proximity sensor, a capacitive sensor, an accelerometer, a tachometer, a mechanical switch, a potentiometer and a rate gyro.

21. The downhole tool actuator of claim 1 further comprising a valve housing that has a replaceable screen to permit access to components that are not within the oil filled housing.

22. The downhole tool actuator of claim 1 further comprising a screen assembly attached to the housing that traps debris.

23. A method for maintaining a downhole tool actuator, comprising:

assembling a downhole actuator having a housing, an actuator in the housing that generates a force to be applied to a downhole tool that is connectable to the actuator, a shock absorbing member, adjacent to the actuator, that absorbs shocks from the actuator, a shaft in the housing that transfers the force of the actuator to the downhole tool that is connectable to the actuator and an electronic control system that electrically communicates with the actuator to provide a power signal and control signals to the actuator;

filling oil into the housing; and installing a compensation mechanism into the housing that balances the pressure within the actuator with a borehole pressure.

24. The method of claim 23 further comprising removing an excess of oil from the housing by opening a port in the housing.

* * * * *